United States Patent [19]

Kojima et al.

[11] Patent Number: 4,830,911

[45] Date of Patent: May 16, 1989

[54] RECORDING SHEET FOR INK JET PRINTERS

[75] Inventors: Yutaka Kojima; Takashi Omori, both of Tokyo, Japan

[73] Assignee: Jujo Paper Co., Ltd., Tokyo, Japan

[21] Appl. No.: 24,128

[22] Filed: Mar. 10, 1987

[30] Foreign Application Priority Data

Nov. 4, 1986 [JP] Japan ..... 61-262563

[51] Int. Cl.[4] ..... B41M 5/00

[52] U.S. Cl. ..... 428/342; 346/135.1; 428/195; 428/207; 428/211; 428/331; 428/341; 428/474.4; 428/475.2; 428/511; 428/522

[58] Field of Search ..... 346/135.1; 428/195, 428/207, 211, 411.1, 331, 341, 342, 474.4, 475.2, 511, 522

[56] References Cited

U.S. PATENT DOCUMENTS 4,371,582 2/1983 Sugiyama et al. ..... 428/511

*Primary Examiner*—Ellis P. Robinson
*Assistant Examiner*—P. R. Schwartz
*Attorney, Agent, or Firm*—Sherman and Shalloway

[57] ABSTRACT

This invention relates to a recording sheet for ink jet printers which gives an image by the use of an aqueous ink containing a water-soluble dye, coated or impregnated with either of or a mixture of two kinds of water-soluble polymers: one whose polymeric unit is alkylquaternaryammonium (meth)acrylate and the other whose polymer unit is alkylquaternaryammonium (meth)acrylamide, said water-soluble polymers containing not less than 50 mol % of a monomer represented by the following formula (1),

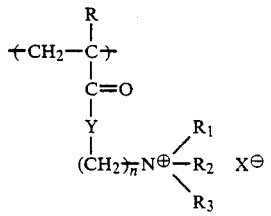

(I)

where R represents hydrogen or methyl group; n is an integer from 1 to 3 inclusive; $R_1$, $R_2$ and $R_3$ represent hydrogen or the same or different aliphatic alkyl group with 1 to 4 carbon atoms; $X^{\ominus}$ represents an anion such as halogen ion, sulfate ion, alkylsulfate ion, alkyl- or aryl-sulfonate ion and acetate ion and Y represents oxygen or imino group.

11 Claims, No Drawings

RECORDING SHEET FOR INK JET PRINTERS

FIELD OF THE INVENTION

This invention relates to a recording sheet for ink jet printers which makes ink images formed on the sheet very water-insoluble or water resistant.

DESCRIPTION OF THE PRIOR ART

Generally, in ink jet printers, in which ink drops are forced through small nozzles by piezoelectric pressure or by oscillation onto paper, an image is formed using dot matrix. In ink jet printing, an aqueous ink of low viscosity consisting of direct dyes or acid dyes is commonly used. For assurring to eject stable ink drops usually, it is rare to use normal printing ink into which pigments or resins are added. On account of that, it is taken for granted that the ink jet record is inferior to ordinary printing in such quality as color density, gloss, light resistance, water resistance, and so on.

However, along with spreading of application fields of ink jet recording system and extending of color printing, requirement for better quality such as water resistance and light resistance has been increasing, as well as for better recording performance such as resolution degree, color density and clarity of color tone.

As for measures for the improvement in resolution degree, color density and clarity of color tone, such proposals that coating color composed of a silica-containing pigment and a water-soluble macromolecular binder should be applied on a recording sheet at a rate of not less than 10 $g/m^2$ are made in Japanese patent laid-open publications Nos. 55-51583, 56-148583 and 56-148585, for example. In this respect, the present inventors have already proposed in U.S. Pat. No. 4,478,910 that images superior in contrast and color reproducibility are able to be obtained by the application of a mixture composed of silica and a water-soluble macromolecular binder, the silica having a Rosin-Rammler distribution equivalent value (n) of not less than 1.10 and a specific surface area of not less than 200 $m^2/g$, measured according to the BET method.

Other than the above, for the purpose of improving water resistance of ink jet-recording images, a process of applying a water-soluble ink on a cationic polymer coated sheet has been proposed.

As a typical cationic polymer for the use, cationic soaps, such as polyethylene imine and polyallylpyridinium halide (Japanese patent laid-open publication No. 56-84992), water-insoluble polymer latex including a copolymer prepared from a monomer with tertiary amino group or quaternary ammonium group and a hydrophobic monomer (Japanese patent laid-open publication No. 57-36692), an electroconductive agent of quaternary ammonium salt type (Japanese patent laid-open publication No. 58-177390), a diallyldialkylammonium halide (Japanese patent laid-open publication No. 59-20696), a dicyandiamido-formalin polycondensate (Japanese patent publication No. 59-146889), a polyalkylene-polyamine-dicyandiamidoammonium condensate (Japanese patent laid-open publication No. 60-49990), a thiourea compound (Japanese patent laid-open publication No. 61-163886) and the like have been proposed.

Moreover, in connection with the above, the combined use of a cationic polymer of these kinds and a polyvalent metal compound has been proposed in Japanese patent laid-open publications Nos. 59-106989, 60-187582 and 61-14979.

Water resistance to images given by these proposals is due to the fact that a water-insoluble complex is formed by the bonding of a direct dye or an acid dye in ink and a cationic polymer, stated in the proposals. However, a recording sheet coated with these cationic polymers has such disadvantages as follows. That is, in the case that cationic soaps, such as polyethylene imine and polyvinylpyridinium halide or cationic polymers, such as diallyldialkylammonium halide and polyalkylene-polyamine-dicyandiamidoammonium condensate are used for a recording sheet, a prominent improvement in water resistance to images can be certainly recognized in the recording sheet than in the one without these kinds of additives. But all colors or a certain color in an image more or less varies from their original color (hereinafter referred to as color difference) or loses light and brightness, with the result that darkish and contrast-poor images are always formed.

It seems that light absorption spectrum pattern of a dye is widely different from that of a dye obtained by great change in their aggregation condition or the formation of too large a macromolecular complex when dyes in ink and such cationic polymer produce a complex.

Moreover, when a basic water-insoluble polymer latex composed of a cationic monomer and a hydrophobic monomer is employed for the production of a ink jet recording sheet, the sheet is inferior in ink absorbability, supposedly due to the presence of hydrophobic group required for the latex formation; therefore, some ink on the latex surface does not undergo water resistance, and this makes the water resistance to images insufficient. Also, due to the reflection arising on the particles of latex boundary, this fact provides whitish, contrast-poor image which is inferior in color density.

SUMMARY OF THE INVENTION

Recently, high speed, high density and high accuracy full color printers and pictorial color printers, which provide as good an image as photography and printing, are increased mostly adopting their unique ink jet recording system that a colored image by a direct color development treatment is obtained. Accordingly, a recording sheet used in the system is strongly requested to have good water resistance to image and good color reproducibility, not to mention good ink absorbability.

Under the circumstances, the present inventors have made an intensive study to eliminate all drawbacks of conventional systems and finally accomplished the invention.

It is an object of the invention to provide a recording sheet for ink jet printers which can give an image with excellent water resistance and good color reproducibility.

The object of the invention can be accomplished by an ink jet recording sheet which gives an image by the use of an aqueous ink containing a water-soluble dye, characterized by being coated or impregnated with either of or a mixture of two kinds of water-soluble polymers: one (a) whose, polymeric unit is alkylquaternaryammonium-methacrylate and the other (b) whose polymeric unit is alkylquaternaryammoniummethacrylamide, said water-soluble polymers having a main structural monomer unit monomer represented by the following formula (I),

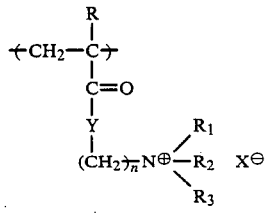

(I)

where R stands for hydrogen or methyl radical; n is an integer from 1 to 3 inclusive; $R_1$, $R_2$, and $R_3$ represent hydrogen or the same or different aliphatic alkyl groups with 1 to 4 carbon atoms; $X^{\ominus}$ represents an anion such as halogen ion, sulfate ion, alkylsulfate ion, alkyl- or arylsulfonate ion and acetate ion; and Y represent oxygen or imino group.

DETAILED DESCRIPTION OF THE INVENTION

The water-soluble polymer to be used in this invention is a polymer or a copolymer including alkyl-quat.-ammonium (meth)acrylate or alkyl-quat.-ammonium (meth)acrylamide. When it is a copolymer, it is desirable to contain not less than 50 mole % of the above quat.-ammonium salt and more desirable to contain not less than 80 mole % of the same salt. If the content of the salt is less than 50 mole % in the water-soluble polymer, the water-resistance and color reproducibility of images formed on a recording sheet cannot avoid lowering.

The other fraction of the water-soluble polymer of the invention may be nonionic or cationic monomers if they can polymerize with the above quat.-ammonium salt. That is, the water soluble copolymer can contain one or more than one kind of such monomers as ethylene, butadiene, styrene, vinyl acetate, lower esters of methacrylate, alkylamine methacrylate, methacrylamide, methacrylonitrile, acrylamidoalkylamine, vinylpyridine and the like to such extent that they do not deteriorate its water-solubility.

The cationic, quat.-ammonium salt type polymer or copolymer of this invention is produced by causing a monomer with tert.-amino radical to polymerize and then making the obtained polymer quaternary with an alkylation agent or by directly causing a quat.-ammonium salt type monomer to polymerize or copolymerize.

In order to cause such monomers to polymerize or copolymerize, conventional processes, such as aqueous solution polymerization process by the use of radical polymerization initiator or redox type polymerization agent, reversed phase emulsion polymerization process, reversed phase suspension polymerization process, which is conducted by emulsifying or suspending a monomer aqueous solution in an organic solvent, precipitation polymerization process, which is conducted in an organic solvent that dissolves a monomer but not a polymer, and any other analoguous polymerization processes can be adopted.

The amount of the water-soluble cationic polymer or copolymer of this invention to be used is different according to how much it is applied on a sheet or the variety and amount of pigment or binder to be used in association therewith. However, the polymer or copolymer has to be used in at least the same chemical equivalent as a dye or dyes in ink; moreover, it is proper for them to be used as much as up to 1.5 times the chemical equivalent of ordinary dyes. Use of more than the above only result in uneconomy although almost no trouble results therefrom.

In the meantime, a recording sheet is commonly coated with a pigment, binder and additive. As a pigment, silica, synthetic silicate, talc, kaolin, clay, ground and precipitated calcium carbonate, other calcium carbonates, acid terra abla, aluminium hydroxide, diatom earth, titanium oxide, zinc oxide, barium sulfate, urea-formalin resin powder, polyethylene micro-powder, polystyrene micro-powder and the like can be used singly or in combination.

As a water soluble binder, PVA, oxidized starch, etherificated starch, other starch derivatives, gelatin, casein, carboxymethylcellulose, other cellulose derivatives, polyvinylpyrridone and the like can be used singly or in combination.

As a latex or emulsion binder such as styrene-butadiene copolymer, methylmethacrylate-butadiene copolymer, acrylic ester copolymer, polyvinylacetate, ethylene-vinylacetate copolymer can be used if necessary.

As an additive, pigment dispersing agent, surfactant, ultraviolet-ray absorbing agent, releasing agent, viscosity adjusting agent, agent for giving cross-links and water-repellence in binders can be used if necessary.

In connection with pigment, silica-based pigments are favorable; especially, wet-processed, synthetic amorphous silica, composed mainly of silicon dioxide, is very suitable for the use in the invention. When the silica and the polymer of this invention are mixed with polyvinyl alcohol in the character of a water-soluble polymer binder, they are the most desirable materials in view of color density and clarity images formed on the recording sheet.

The quantitative proportion of a pigment, water-soluble polymer binder and the quat.-ammonium salt type polymer of the invention in one material should be determined according to what property is requested for the recording sheet; moreover, it may be changed according to how much other additives are used together or how much the material is applied on the recording sheet.

Generally speaking, however, based on 100 parts by weight of a pigment, the amount of a water-soluble polymer binder is desirable to be 10–40 parts by weight and more desirable to be 15–30 parts by weight; the amount of the polymer of this invention is desirable to be 1–50 parts by weight, more desirable to be 1–30 parts by weight and most desirable to be 2–15 parts by weight. It is because when the amount of the polymer of this invention is less than 1 part by weight, images formed on the recording sheet are poor in water resistance; reversely, when it is more than 50 parts by weight, the recording sheet tends to lose the ink absorbability because of the excess amount of the polymer, relative to the other material.

However, in the case that less than 1% of cationic surfactant is added together, images formed on a recording sheet have sufficient water-resistance, even if the amount of the polymer of this invention is less than 1 part by weight. Likewise, in the case that less amount of the material is applied on a recording sheet, the sheet would not lose the ink absorbability, even if the polymer of this invention amount to more than 50 parts by weight.

Additionally, when the amount of a water-soluble polymer binder is under the prescribed proportion, the bonding force of the material to a recording sheet becomes insufficient; as a result, the material shakes off the recording sheet. Reversely, when it is over the prescribed proportion, the effectiveness of a pigment is decreased, the recording sheet tends to lose the ink absorbability; in consequence, images formed on the recording sheet become sticky and lose clarity due to the uneven ink diffusion into the recording sheet.

When the amount of the quat.-ammonium salt type polymer of this invention is under the prescribed proportion, the improvement in the water resistance to images comes to be insufficient; and when it is over the prescribed proportion, the color of image becomes so changeable and the lightness becomes so lower that the reproducibility of color tends to be insufficient.

The amount of the quat.-ammonium salt type polymer of this invention to be applied on a recording sheet by coating or impregnation is commonly in the range from 0.05 to 2.5 $g/m^2$ as solid and desirable to be in the range from 0.1 to 1.5 $g/m^2$, as solid. In such case, it gives a sufficient water resistance to images.

The methods of coating color on the paper can be carried out by conventional devices, such as a size press, gate-roll coater, air knife coater, spray and the like. For a great amount of coating color an off-machine can be used; for small amount of coating color an on-machine can be used.

Meanwhile, it is still unclear why the quat.-ammonium salt type polymer of this invention provides an excellent result in improving the water resistance to images and the color reproducibility of ink; however, the present inventors have the following idea for the reason.

The bonding between a cationic polymer and a dye used in the ink jet recording system is generally ionic. But it can be assumed that the conformation of a polymer, which results from the polymer chemical structure, form and size, the cationicity strength of a polymer and the population of cationic radicals in a polymer give a large influence to the binding strength of the polymer and the dye, which may supposedly further determine the superiority or inferiority of the water resistance to images and color reproducibility of ink.

In view of the above, in order to increase the water resistance to images it is necessary that a cationic polymer and a dye are bound with strong affinity and a complex of the polymer and the dye would not be readily separated from a recording sheet by water.

Furthermore, in order that a cationic polymer and a dye have a strong bond, it is required that many cationic radicals exist in the polymer and have the structure approachable to a dye molecule. Additionally, when a cationic polymer has such three-dimensional network structure a sufficient water resistance is obtained owing to a dye surrounded in three dimension network. If, however, the dispersion condition of a dye would be affected by strong ionic bond, capture by a polymer and hydrophobic or substituted radicals, the reflection or absorption spectrum inherent to the dye could change, which may deteriorate the clearness of images and increase their color difference.

In this respect, in the quat.-ammonium salt type polymer of this invention, cationic radicals are populated densely and dye molecules are firmly captured by virtue of good spatial relation between ester and cationic radicals and between amide and cationic radicals; in addition, being water-soluble and linear, the polymer neither has any such three-dimensional network structure nor almost causes and such change in the dispersion or aggregation condition of a dye by the presence of hydrophobic or substituted radicals that the color difference of images can be controlled to the minimum extent.

The invention will be explained in more detail according to the following examples, in which parts and percent are intended to indicate by weight unless otherwise described.

Polymer Preparation Example 1 (Polymer A)

Dimethylaminoethylmethacrylate was made quaternary by the use of methylchloride so as to give β-methacroyloxytrimethylammonium chloride. One hundred and three grams of the product were dissolved in 110 g of water having passed an ion exchange filter, in which 0.14 g of ethylenediamine, 0.23 g of azobisisobutyronitrile (polymerization initiator), and 0.3 g of 1% polyoxyethylenenonylether aqueous solution were mixed. After the air in a reaction vessel was substituted for nitrogen, 5.3 g of 1% potassium persulfate and 8.24 g of 2% tetramethylethylenediamine were added thereto.

Reaction was made at 40° C. for 4 hours and then completed at 60° C. for 2 hours. After the reaction, produced polymer was separated and rinsed with acetone, and then dried under reduced pressure; as a result, some polymer powder yielded.

Polymer Preparation Example 2 (Polymer B)

Polymerization was carried out in the same procedure as in Example 1, with the exception that dimethylaminoethylmethacrylate was made quaternary by the use of dimethylsulfate and 140 g of the quaternary product was used.

Polymer Preparation Example 3 (Polymer C)

Polymerization was carried out in the same procedure as in Example 1, with the exception that 110 g of methacrylamidopropyltrimethylammonium chloride were used.

Polymer Preparation Example 4 (Polymer D)

Put in 324 g of distilled water were 24 g of cetyltrimethylammonium chloride and 1.0 g of 10% polyvinylalcohol aqueous solution. Substitution of the air in a reaction vessel for nitrogen was made. Subsequently, 67.4 g of β-methacroyloxyethyltrimethylammonium chloride and 3.2 g of styrene were added thereto with stirring to cause emulsification.

When temperature reached 60° C., 2.9 g of 1% potassium persulfate and 0.2 g of sodium hydrogensulfite were added to make polymerization for 5 hours.

After reaction was over, acetone was put in the reacted solution to separate and rinse a produced polymer, which was then dried so as to give powder.

Polymer Preparation Examples 5 to 7 (Polymers F, G and H)

Each of polymerization were carried out in the same manner as in Example 1 by the use of 163.5 g of β-methacroyloxyethyldimethylepichlorhydrinammonium chloride, 162.7 g of β-methacroyloxyethyldiethylbenzylammonium chloride and 116 g of 4-vinyl-N-benzylpyridinium chloride respectively.

Polymers F, G and H were obtained as a result.

Polymer Preparation Example 8 (Polymer M)

Dissolved in 1200 g of degassed water were 101.7 g of β-methacroyloxyethyltrimethylammonium chloride. The aqueous solution was heated to 60° C. in the nitrogen atmosphere; subsequently, 51.03 g of styrene and 2.8 g of divinylbenzene were added thereto. After solution of 5.24 g of 2.2-azobis(2-aminodipropane) dihydrochlorate dissolved in 3.8 ml of degassed water was added thereto and stirring and heating were made for 3 hours, the solution mixture was cooled down to 25° C. A polymer with 13% solid content and 17.5 cps viscosity was obtained as a result.

Preparation for Determinations and Tests (1) Determination of the Cationicity of Polymers The cationicity of polymers used in the examples was determined as in normality by the colloid titration method.

One milliliter of 1% polymer solution is taken out with exactness, to which 20 ml of pure water, 2 ml of acetic acid and 2 drops of Toluidine Blue indicator are added. The solution mixture is titrated by the use of 1/400N polyvinylpotassium sulfate. The amount of cationic polymers to be used for the comparison of their properties is decided inversely proportional to the determined normality so that the same amount of cation is contained in every prepared composite.

(2) Color Density of & Water Resistance to Recorded Images

The ink spot method is applied for the determination of the color density and the water resistance of images formed on a recording sheet.

The ink spot method: a certain amount of ink resting on the top of a glass rod of diameter about 8 mm is put directly on top of a recording sheet and an excess amount of the ink is removed by a blotting paper put thereon shortly thereafter so as to give an ink spot.

The method has a characteristic that influences involved in colorimetry, which arise following the variation in the proportion of recorded and unrecorded areas brought about by a change in the ink dot size caused by the surface propery of a recording sheet, can be eliminated.

Three primary colored inks, cyan, magenta and yellow, available on the market as for use in ink jet printers under the tradename "Ink Jet Color Image Printer IO-700" of Sharp Corporation were used.

A reflection densitometer (RD 915 type product of Macbeth Co., Ltd.) is used for the determination of the reflection density of each colored ink spot.

If the color density before and after 24 hours' immersion in town water are expressed as A and B respectively, then the percentage of the color fastness of images to water (%) is expressed as follows:

$$\frac{A-B}{A} \times 100(\%)$$

(3) Color Vividness & Color Difference of Images

In this invention, hue difference and saturation difference are used as a criteria to estimate the color vividness and color difference of images.

Generally, color is indicated by the three attributes: lightness (L), hue (H) and saturation (S). According to color specification system which CIE recommends, CIE's representation system there are used L*, a* and b*,

| | |
|---|---|
| Lightness: | L*, |
| Hue: | $H^* = \tan^{-1}(a^*/b^*)$ and |
| Saturation: | $S^* = C^*/L^*$ |
| where C* is equal to | $a^{*2} + b^{*2}$. |

If colors in each unrecorded and recorded areas in the comparative sheet (blank example sheet) into which no polymer for water resistance is added, and in the example sheet into which polymer is added, are represented by Lo*, ao*, bo* and Ls*, as*, bs*; moreover, the lightness, hue and saturation of each recorded area in the former and latter calculated by the above equations are represented by Lo*, Ho*, So* and Ls*, Hs*, Ss*, then the color vividness and color difference deviation can be expressed as follows:

| | |
|---|---|
| Color vividness: | $\Delta H^* = Hs^* - Ho^*$ |
| Color differences: | $\Delta S^* = Ss^* - So^*$ |

L*, a* and b* of respective colors can be obtained by the measurements of colored ink spots with a Z-80 type color difference meter, produced by Nihon Denshoku Kogyo K.K. Values of lightness, hue, saturation and hue difference and saturation difference, i.e. color difference and color vividness can be obtained by putting each measurement result in the above equations.

Tables 1 and 2 show that the smaller the absolute value of the hue difference which a recorded area in an example sheet has, compared with a that in the blank example sheet, the smaller the color deviation is; and the larger the positive value of the saturation difference which a recorded area in an example sheet has, compared with that in the blank example sheet, the better the color vividness is.

The structure of every cationic polymer used in Examples and Comparative Examples to clearly show the effectiveness of a recording sheet of this invention will be given as follows:

Polymers within the invention:

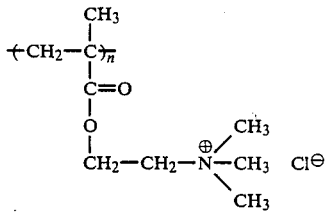

Polymer A

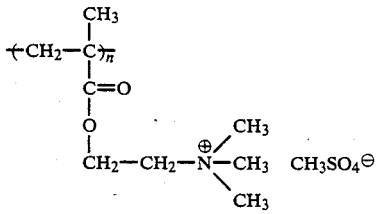

Polymer B

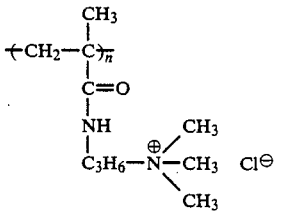

Polymer C

-continued

Polymer D

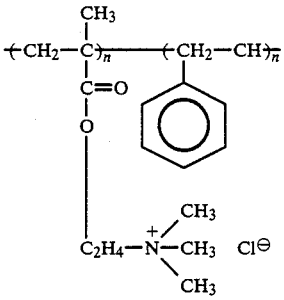

n:m = 9:1

Polymers without the invention:

Polymer E

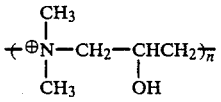

Polymer F

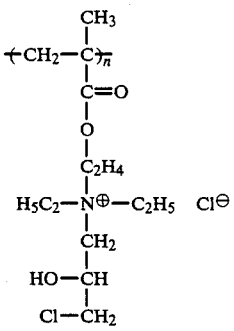

Polymer G

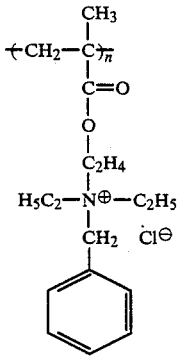

Polymer H

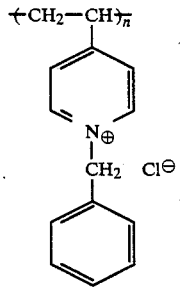

-continued

Polymer I

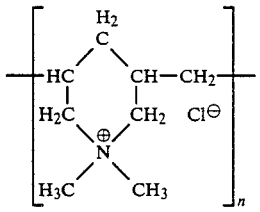

Polymer J

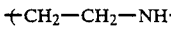

Polymer K

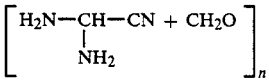

Polymer L

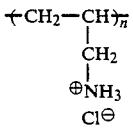

Polymer M

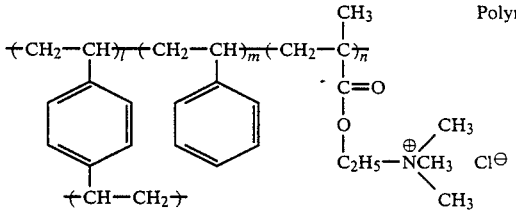

l:m:n = 2:49:49

EXAMPLE 1

A coating color with 15.4% solid content was prepared by mixing 500 parts of slurry containing 17% of man-made silica (pigment) with a specific surface area of 220 $m^2/g$, mean aggregation diameter of 2.5 microns and a Rosin-Rammler distribution equivalent number (n) of 1.3 with 150 parts of 10% polyvinylalcohol (PVA 117 type product of Kuraray Co., Ltd.) aqueous solution and then adding thereto a proper amount of water. Added to 1000 parts of the coating color were 36 parts of 20% Polymer A solution.

Neutralized paper with a weight of 60 $g/m^2$, which was manufactured by using Fourdrinier machine by the addition of 20 parts of precipitated calcium carbonate (PC type product of Shiraishi Kogyo K.K.) to a material pulp composed of 80 parts of LBKP of 350 ml c.s. freeness and 20 parts of NBKP of 400 ml c.s. freeness was used and was coated with the materials by means of a wire bar so that the coating weight was about 10 $g/m^2$.

In order to prepare a recording sheet, the coated sheet was gloss calendered so that the Beck's degree of smoothness was 100 seconds.

Before the determination of the color density, color deviation and water resistance, an image was made on the recording sheet by the ink spot method mentioned above.

Table 1 shows the result. Compared with a recording sheet of Comparative Example 1, the one in Example 1 proved to have good color fastness to water after 24 hours' immersion in water. The color difference obtained from $\Delta H^*$, is within 0.05; the color vividness, obtained from $\Delta S^*$, is in the positive value although it is small, which means the image in Example 1 is more clarity than the standard one.

EXAMPLES 2 TO 4

Three sorts of recording sheets were manufactured in the same manner as in Example 1 by replacing Polymer A with Polymers B, C and D respectively, provided as for Polymer B, whose counter ion is methylsulfate ion, 31 parts of its 18% aqueous solution, as for Polymer C, 29.1 parts of its 20% aqueous solution and as for Polymer D, 22.3 parts of its 20% aqueous solution were prepared and used.

As shown in Table 1, Polymers B, C and D gave excellent water resistance, color density and clearness, as well as small color deviation, as in Example 1.

Comparative Example 1

A sheet produced in the same way as Example 1, except that polycation is not added to a paint to coat the substrate with, is used as a comparative recording sheet. The color deviation, clearness, and color density of images recorded on the sheet are used as a criterion for comparing polycations capacity by the ink spot method.

Comparative Examples 2 to 10

In place of Polymer A within the invention, the following polymers E–M were mixed respectively so as to make up a paint composite; their amount is decided based on the determined cationicity of their own, as given in Table 1.

Every recording sheet corresponding to Polymers E–M was prepared in the same way as in Example 1, with all other conditions kept unchanged.

The detail of the polymers is as follows:

| | |
|---|---|
| Polymer E: | polymer of dimethyl-2-hydroxypropylammonium salt (Neofix REY, product of Nikka Kagaku Kogyo K.K.) |
| Polymer F: | polymer of quat.-ammonium salt of ethylmethacrylate (organic electroconductive agent) |
| Polymer G: | polymer of quat.-ammonium salt of ethylmethacrylate (organic electroconductive agent) |
| Polymer H: | polymer of benzylvinylpyridine |
| Polymer I: | polydimethyldiallylammonium chloride (PAS-H 10 L, product of Nitto Boseki Co., Ltd.) |
| Polymer J: | polyethyleneimine (Epomin P 1000, product of Nihon Shokubai Kagaku Kogyo K.K.) |
| Polymer K: | dicyandiamidoformalin polycondensate (Neofix FY, product of Nikka Kagaku Kogyo K.K.) |

-continued

| | |
|---|---|
| Polymer L: | polyallylamine hydrochlorate (PAA-HCLH, product of Nitto Boseki Co., Ltd.) |
| Polymer M: | Basic water-insoluble latex |

The color difference, color vividness, density and wate resistance given by the addition of these polymer, which were also determined by the ink spot method, are shown in Table 1 as Comparative Examples.

It becomes evident from Table 1 that the water resistance is improved by the addition of these polymers, as seen in Comparative Examples 5 and 6, where it is comparable or rather better than in Examples of this invention, but the color difference is remarkable in every case.

These polymers, although they have similar structure to that of the polymers within this invention, are poor in the water resistance expecially when they a strong hydrophilic or hydrophobic group on the side chain, as seen in Comparative Examples 3 and 4.

Polymer M in Comparative Example 10, a basic water-insoluble latex, showed bad result in the color density and water resistance, contrary to the inventors' expectations. This may be related to poor ink absorbability of the composite due to strong hydrophobicity of the polymer.

EXAMPLE 5

A coating color with 31.25% solid content was prepared by mixing 170 parts of slurry containing 50% of precipitated calcium carbonate (PX, product of Shiraishi Kogyo K.K.) with 150 parts of 10% PVA binder aqueous solution. Added to the paint composite was 12 parts of 20% Polymer A aqueous solution. The mixture was applied on a sheet so that the application amount was about 30 g/m$^2$.

Comparative Examples 11 and 12

A recording sheet was prepared in the same way as in Example 5 without Polymer A and by replacing Polymer A with Polymer G respectively.

Table 2 shows the result of the recording sheets with Polymer A (Example), the recording sheet without Polymer A (Comparative Example 11) and with Polymer G (Comparative Example 12).

It becomes clear from Table 2 that in Example 5 the color difference is better than in Comparative Example 10 and color vividness is good, whereas in Comparative Example 12 the water resistance, color difference and color vividness are all poorer than in Example 5.

TABLE 1

| | Com. Ex. | Examples | | | | Comparative Examples | | | | | | | | |
|---|---|---|---|---|---|---|---|---|---|---|---|---|---|---|
| | 1 | 1 | 2 | 3 | 4 | 2 | 3 | 4 | 5 | 6 | 7 | 8 | 9 | 10 |
| Polymer | none | (A) | (B) | (C) | (D) | (E) | (F) | (G) | (H) | (I) | (J) | (K) | (L) | (M) |
| mg eq./l g Polymer | | 4.57 | 3.63 | 4.76 | 4.66 | 7.37 | 3.31 | 2.88 | 4.02 | 4.23 | 20.99 | 3.93 | 9.21 | 2.94 |
| Coating Material*1 | | | | | | | | | | | | | | |
| Silica | 85 | 85.0 | 85 | 85 | 85 | 85 | 85 | 85 | 85 | 85 | 85 | 85 | 85 | 85 |
| PVA | 15 | 15 | 15 | 15 | 15 | 15 | 15 | 15 | 15 | 15 | 15 | 15 | 15 | 15 |
| Polymer | | 4.68 | 5.89 | 4.49 | 4.59 | 2.90 | 6.46 | 7.43 | 5.32 | 5.06 | 1.02 | 5.44 | 2.32 | 7.27 |
| Quality of Produced Image | | | | | | | | | | | | | | |
| (1) Color density | | | | | | | | | | | | | | |
| Cyan | 1.77 | 1.75 | 1.75 | 1.79 | 1.73 | 1.84 | 1.91 | 1.71 | 1.88 | 1.80 | 1.80 | 1.75 | 1.72 | 1.38 |
| Magenta | 1.74 | 1.70 | 1.80 | 1.79 | 1.78 | 1.80 | 1.81 | 1.75 | 1.85 | 1.72 | 1.68 | 1.77 | 1.74 | 1.40 |

TABLE 1-continued

| | Com. Ex. | Examples | | | | Comparative Examples | | | | | | | | |
|---|---|---|---|---|---|---|---|---|---|---|---|---|---|---|
| | 1 | 1 | 2 | 3 | 4 | 2 | 3 | 4 | 5 | 6 | 7 | 8 | 9 | 10 |
| Yellow | 1.57 | 1.63 | 1.60 | 1.60 | 1.56 | 1.66 | 1.75 | 1.60 | 1.64 | 1.62 | 1.54 | 1.62 | 1.66 | 1.25 |
| (2) Water-resistance*2 | | | | | | | | | | | | | | |
| Cyan | 91.0% | 0.0 | −3.2 | −1.7 | −3.0 | 43.5 | 10.6 | 69.8 | 7.4 | 6.1 | 62.8 | −0.5 | −2.3 | 63.1 |
| Magenta | 88.5% | 7.6 | 7.9 | 9.8 | 8.3 | 83.3 | 52.5 | 80.9 | 2.7 | 17.0 | 80.4 | 37.9 | 46.4 | 72.1 |
| Yellow | 77.1% | −1.9 | 1.2 | 2.4 | 2.1 | 36.1 | 0.5 | 40.0 | −5.2 | 5.4 | 53.9 | −1.2 | 6.0 | 64.7 |
| (3) Color difference(H*) | | | | | | | | | | | | | | |
| Cyan | 0.00 | −0.01 | 0.00 | 0.03 | 0.04 | −0.22 | −0.25 | −0.17 | −0.28 | −0.25 | −0.31 | −0.30 | −0.25 | −0.04 |
| Magenta | 0.00 | −0.03 | 0.01 | 0.03 | 0.01 | −0.09 | −0.17 | −0.10 | −0.22 | −0.33 | −0.41 | −0.25 | −0.37 | −0.01 |
| Yellow | 0.00 | 0.04 | −0.02 | 0.00 | −0.03 | −0.97 | −3.01 | −3.11 | −3.11 | −0.17 | −0.15 | −0.18 | −0.16 | −0.07 |
| Total (Absolute) | 0.00 | 0.08 | 0.03 | 0.06 | 0.08 | 1.27 | 3.43 | 3.38 | 0.61 | 0.75 | 0.87 | 0.73 | 0.78 | 0.12 |
| (4) Color vividness(S*) | | | | | | | | | | | | | | |
| Cyan | 0.00 | 0.12 | 0.14 | 0.10 | 0.15 | 0.13 | 0.03 | 0.05 | 0.02 | 0.03 | 0.04 | −0.15 | 0.11 | −0.09 |
| Magenta | 0.00 | 0.18 | 0.09 | 0.11 | 0.08 | 0.01 | 0.01 | −0.05 | 0.10 | 0.07 | 0.03 | −0.12 | 0.04 | −0.05 |
| Yellow | 0.00 | 0.07 | 0.13 | 0.09 | 0.10 | 0.03 | 0.05 | −0.03 | 0.04 | 0.03 | 0.01 | 0.03 | 0.04 | −0.07 |
| Total | 0.00 | 0.35 | 0.36 | 0.30 | 0.33 | 0.17 | 0.09 | −0.03 | 0.16 | 0.13 | 0.08 | −0.24 | 0.19 | −0.21 |

*1Part by weight in solid content
*2The negative symbol shows that color has deepened after immersion in water

TABLE 2

| | Example 5 | Comp. Ex. | | | | | Example 6 | | | |
|---|---|---|---|---|---|---|---|---|---|---|
| Polymer | (A) | none | (C) | | | | (A) | | | |
| mg eq./l g Polymer | 4.57 | | 2.88 | | | | 4.57 | | | |
| Coating Material*1 | | | | Silica | Silica | Silica | Silica | Silica | Silica | Silica |
| Calcium carbonate | 85 | 85 | 85 | 85 | 85 | 85 | 85 | 85 | 85 | 85 |
| PVA | 15 | 15 | | 15 | 15 | 15 | 15 | 15 | 15 | 15 |
| Polymer | 2.4 | | | 0 | 1 | 3 | 5 | 10 | 30 | 50 |
| Quality of Produced Image | | | | | | | | | | |
| (1) Color density | | | | | | | | | | |
| Cyan | 1.01 | 1.12 | 0.98 | 1.76 | 1.76 | 1.76 | 1.76 | 1.81 | 1.84 | 1.57 |
| Magenta | 1.11 | 1.03 | 1.09 | 1.75 | 1.74 | 1.70 | 1.71 | 1.73 | 1.79 | 1.74 |
| Yellow | 1.06 | 1.08 | 1.06 | 1.58 | 1.58 | 1.58 | 1.62 | 1.66 | 1.69 | 1.63 |
| (2) Water resistance*2 | | | | | | | | | | |
| Cyan | 0.3% | 93.6 | 65.6 | 89.8 | 43.5 | 10.6 | 2.3 | −2.0 | −5.2 | −7.3 |
| Magenta | 9.3% | 89.5 | 66.6 | 91.5 | 61.9 | 48.9 | 10.8 | 4.4 | −1.0 | −1.1 |
| Yellow | 0.9% | 80.2 | 59.7 | 72.3 | 31.9 | 11.2 | −0.2 | −1.8 | −5.7 | −1.5 |
| (3) Color difference (ΔH*) | | | | | | | | | | |
| Cyan | −0.08 | 0.00 | −0.25 | 0.00 | 0.00 | −0.02 | −0.05 | −0.05 | −0.06 | −0.04 |
| Magenta | −0.04 | 0.00 | −0.10 | 0.00 | 0.01 | 0.02 | 0.02 | 0.03 | 0.03 | 0.05 |
| Yellow | −0.02 | 0.00 | −3.43 | 0.00 | 0.02 | 0.05 | 0.07 | 0.08 | 0.07 | 0.07 |
| Total (Absolute) | 0.14 | 0.00 | 3.78 | 0.00 | 0.03 | 0.09 | 0.14 | 0.16 | 0.16 | 0.16 |
| (4) Color vividness (ΔS*) | | | | | | | | | | |
| Cyan | −0.15 | 0.00 | −0.77 | 0.00 | 0.04 | 0.12 | 0.15 | 0.18 | 0.19 | 0.13 |
| Magenta | −0.11 | 0.00 | −0.96 | 0.00 | 0.02 | 0.09 | 0.15 | 0.17 | 0.21 | 0.22 |
| Yellow | 0.14 | 0.00 | −3.41 | 0.00 | 0.02 | 0.05 | 0.06 | 0.08 | 0.10 | 0.09 |
| Total | −0.12 | 0.00 | −5.14 | 0.00 | 0.08 | 0.26 | 0.36 | 0.41 | 0.50 | 0.44 |

EXAMPLE 6

In order to study the relation between the effectiveness and the amount of Polymer A, 1, 3, 5, 10, 30 and 50 parts of it were added into a mixture composed of 100 parts of silica and 100 parts of PVA, respectively. A recording sheet was prepared with these coating colors in the same manner as in Example 1. Table 2 shows the result, from which it becomes evident that the polymer of this invention exhibits good water resistance to images at a comparatively small addition amount; on the contrary, it does not give bad influence to the color difference and color vividness at a large addition amount.

According to the invention, a recording sheet with good ink absorbability that gives high color density, excellent water resistance, less color difference and high color vividness to images can be formed; therefore, when such recording sheet is employed for a high density, high accuracy full color printer, ink jet recorded images with high color reproductivity to the original color can be obtained.

What is claimed is:

1. A recording sheet for ink-jet printers capable of forming water-resistant images by the use of an aqueous ink containing a water-soluble dye, said sheet being coated or impregnated with at least one water-soluble polymer containing not less than 50 mol % of repeating monomer units represented by the following formula (I):

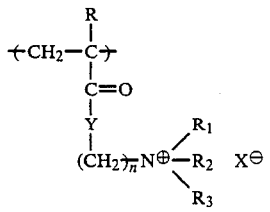

(I)

wherein R represents hydrogen or methyl group; n is an integer from 1 to 3 inclusive; $R_1$, $R_2$ and $R_3$ represent hydrogen or the same or different aliphatic alkyl group with 1 to 4 carbon atoms; $X^{\ominus}$ represents an ion; and Y represents oxygen or imino group.

2. A recording sheet according to claim 1, characterized in that said at least one water-soluble polymer contains not less than 80 mol % of said monomer represented by the formula (I).

3. A recording sheet according to claim 1, characterized in that said recording sheet is coated with a coating material containing said at least one water-soluble polymer and synthesized silica.

4. A recording sheet according to claim 1, characterized in that said recording sheet is coated with a coating material containing said at least one water-soluble polymer, synthesized silica and polyvinyl alcohol.

5. A recording sheet according to claim 1, characterized in that 1 to 50 parts by weight of said at least one water-soluble polymer is used on the basis of 100 parts by weight of pigment.

6. A recording sheet according to claim 5, characterized in that 1 to 30 parts by weight of said at least one water-soluble polymer is used on the basis of 100 parts by weight of said pigment.

7. A recording sheet according to claim 1, characterized in that the amount of said at least one water-soluble polymer to be applied on a sheet by coating or impregnation is 0.05–2.5 $g/m^2$.

8. A recording sheet according to claim 1, wherein Y represents oxygen.

9. A recording sheet according to claim 1, wherein Y represents imino group.

10. A recording sheet according to claim 1, wherein a mixture of water-soluble polymers is used, one of which contains not less than 50 mol % of the monomer represented by the formula (I) in which Y represents oxygen and another containing not less than 50 mol % of the monomer represented by formula (I) in which Y represents imino group.

11. A recording sheet according to claim 1, wherein the anion $X^{\ominus}$ is selected from the group consisting of halogen ion, sulfate ion, alkyl ion, alkylsulfonate ion, arylsulfonate ion and acetate ion.

* * * * *